United States Patent [19]

Sirkin

[11] 4,075,809

[45] Feb. 28, 1978

[54] HOLE REPAIR DEVICE

[76] Inventor: Theodore M. Sirkin, 15401 Saticoy St., Van Nuys, Calif. 91406

[21] Appl. No.: 646,065

[22] Filed: Jan. 2, 1976

[51] Int. Cl.[2] ..... E04G 23/02

[52] U.S. Cl. ..... 52/514; 52/98

[58] Field of Search ..... 52/514, 98, DIG. 1, 52/749; 135/19.5, 33 R, 34

[56] References Cited

U.S. PATENT DOCUMENTS

| | | | |
|---|---|---|---|
| 1,345,067 | 6/1920 | Brown | 135/19.5 |
| 2,376,279 | 5/1945 | Schlenkert | 52/98 |
| 2,598,194 | 5/1952 | Shippey | 52/514 |
| 3,205,904 | 9/1965 | Kreachbaum | 135/19.5 |
| 3,289,374 | 12/1966 | Metz | 52/514 |
| 3,325,955 | 6/1967 | Haut | 52/514 |
| 3,690,084 | 9/1972 | Leblanc | 52/514 |
| 3,834,107 | 9/1974 | Standing | 52/514 |
| 3,936,988 | 2/1976 | Miceli | 52/514 |

*Primary Examiner*—Ernest R. Purser
*Assistant Examiner*—Henry Raduazo
*Attorney, Agent, or Firm*—Edmond T. Patnaude

[57] ABSTRACT

A hole repair device employs a dish shaped resilient member having a centrally disposed threaded opening receiving an elongated thin screw having a pointed end. In use the dish member is compressed and pressed through the hole to be repaired and is thereafter rotated back on the screw until the circumferential portion of the dish shaped member engages a continuous area surrounding the hole to be repaired. A suitable filler such as plaster, cement or putty is then filled into the hole against the dish member and the screw is broken off inside the repaired surface of the wall.

1 Claim, 4 Drawing Figures

HOLE REPAIR DEVICE

The present invention relates in general to the art of repairing holes in hollow wall members and it relates more particularly to a new and improved device for facillating the repair of hollow doors, walls and the like.

BACKGROUND OF THE INVENTION

When one of the surface panels of a hollow wall member such as a door or the like becomes broken, it is difficult for the average person to repair it. Various devices have been designed and placed on the market for providing a backup surface against which a filler material is packed into the opening. These prior art devices are, however, complex in construction, expensive to manufacture, and difficult to use. It would be desirable, therefore, to provide a backup device which is simple in construction, inexpensive to manufacture and which can be readily used by the average person to repair holes in hollow walled articles.

SUMMARY OF THE INVENTION

Briefly, in accordance with the present invention there is provided a dish shaped rubber or other elastomeric member having a threaded opening at the center through which a thin screw is threadedly disposed. The end of the screw on the side of the convex portion of the dish member is sharpened for firm engagement with the inner surface of the wall opposite the hole. The screw is relatively thin and fragile so as to be readily broken off a short distance outwardly of the dish member after the dish member has been unscrewed thereon against the inner surface of the wall surrounding the hole to be repaired.

BRIEF DESCRIPTION OF THE DRAWING

Further objects and advantages and a better understanding of the present invention can be had by reference to the following detailed description, wherein.

DETAILED DESCRIPTION OF THE INVENTION

Figure 1:
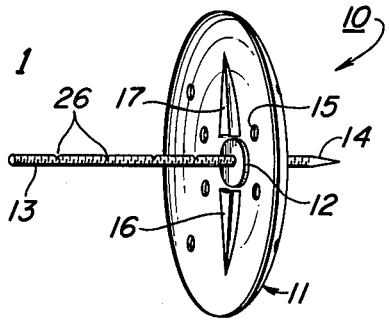
FIG. 1 is a perspective view of the hole repairing device of the present invention.

Referring to FIG. 1, there is shown a hole repairing device 10 which comprises as its principle elements a concavo-convex resilient member 11 formed of rubber or other resilient material having a grommet fixedly mounted at the center and provided with an internal thread through which a thin screw 13 is threadly disposed. The screw has a pointed or otherwise sharpened end 14 on the convex side of the dish shaped member 11. The member 11 is provided with a plurality of holes 15 and a pair of radially extending integral ribs 16 and 17 are disposed on the concave side thereof.

Figure 2:
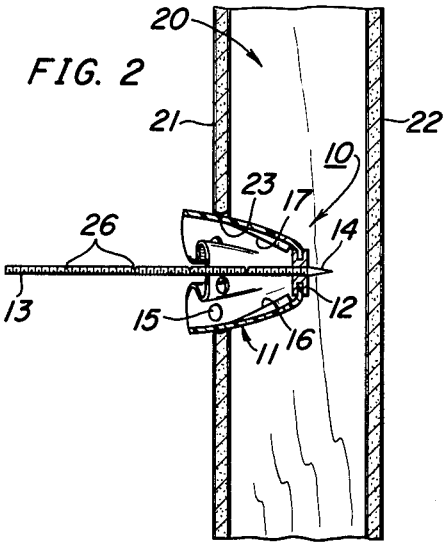
FIG. 2 is a cross-sectional view of the tool of the present invention in the process of being inserted into a wall through a hole therein.
Figure 3:
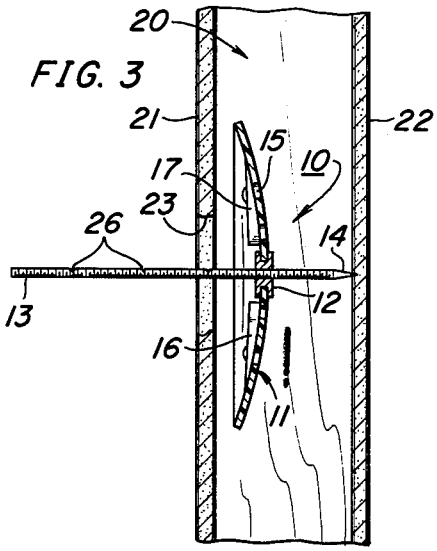
FIG. 3 is a cross-sectional view similar to that of FIG. 2 but illustrating the flexible dish member within the space in a hollow wall member.
Figure 4:
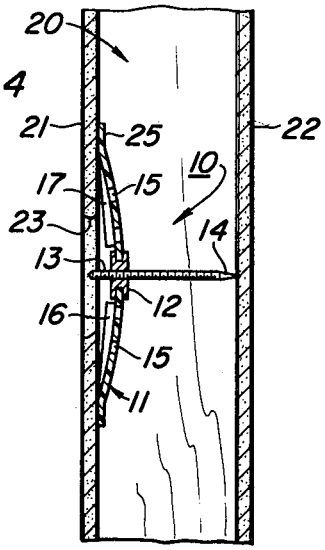
FIG. 4 is a cross-sectional view illustrating the device of the present invention ready for the application of a suitable filler material into the hole to be repaired.

Referring to FIGS. 2, 3 and 4, a hollow walled member such as hollow core door 20 comprises a pair of spaced apart panels 21 and 22. The panel 21 has a hole 23 therein to be repaired. In use, the screw 13 is threaded back a substantial distance from the position shown in FIG. 1 so that the pointed end 14 is in proximity to the grommet 11. The dish shaped member 11 is then compressed and inserted through the opening 23 to be repaired. When the member 11 has been pressed completely through the opening its natural resiliency causes it to return to its original shape as illustrated in FIG. 3. As there shown, the member 11 is within the cavity in the wall 20. The dish 11 is then rotated counterclockwise to move it outwardly into tight engagement with the inner surface of the wall 21 as shown in FIG. 4. The ribs 16 and 17 facilitate the rotation of the member 11. It will be noted that the ribs 16 and 17 have a dimension parallel to the screw 13 which is substantially less than the corresponding dimension of the member 11. Accordingly, as the dish is rotated counterclockwise into engagement with the wall 21, a substantial pressure can be exerted between the circumferential portion of the member 11 and the inner surface 21 to deform the circumferential portion in the shape illustrated at 25 in FIG. 4. The ribs 16 and 17, in addition to providing means for manually rotating the member 11 also strengthen the member 11 to prevent it from flexing away from the wall 21 when a filler is later added.

As shown in FIG. 4 the screw 13 is broken away inside the outer surface of the wall 21 so that when a filler material such as plaster, plastic wood, putty or the like is filled into the hole and the backing space the screw 13 does not show. The openings 15 in the member 11 permit a portion of the filler material to be pressed therethrough so that when the filler material sets up, the member 11 becomes an integral part of the patch. Also, because of the space provided between the member 11 and the portion of the rear surface of the wall 21 surrounding the hole 23, the set up filler material cannot be pulled outwardly of the wall 21.

As shown in FIG. 1 the screw 13 may be provided with a plurality of shallow notches 26 which facilitate breaking off the screw 13 at the desired place.

The dimensions of the body member 11 are not critical and vary with the size of the hole to be filled. Preferably the member 11 should have a diameter approximately twice the maximum dimension of the hole to be repaired. However, either larger or smaller diameter members may be used so long as the member can be fitted through the opening to be repaired and has an unstressed size greater than that of the hole to be repaired.

While the present invention has been described in connection with a particular embodiment thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed is:

1. A device for use in repairing a hole in a hollow structure such as a wall, comprising an elastomeric concavo-convex circular member, said member having a plurality of holes therethrough, a plurality of radially extending ribs on the concave side of said member, said ribs terminating a substantial distance from the perimeter of said member.

* * * * *